US009436204B2

(12) United States Patent
Nagakura et al.

(10) Patent No.: US 9,436,204 B2
(45) Date of Patent: Sep. 6, 2016

(54) BAND-GAP REFERENCE VOLTAGE CIRCUIT

(71) Applicant: Murata Manufacturing Co., Ltd., Kyoto (JP)

(72) Inventors: Terukazu Nagakura, Kyoto (JP); Tadashi Matsuoka, Kyoto (JP); Fuminori Morisawa, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/816,262

(22) Filed: Aug. 3, 2015

(65) Prior Publication Data

US 2016/0062382 A1 Mar. 3, 2016

(30) Foreign Application Priority Data

Aug. 28, 2014 (JP) ..... 2014-174415

(51) Int. Cl.
*G05F 3/08* (2006.01)

(52) U.S. Cl.
CPC ..... *G05F 3/08* (2013.01)

(58) Field of Classification Search
CPC ..... G05F 3/08
See application file for complete search history.

(56) References Cited

U.S. PATENT DOCUMENTS 5,103,159 A * 4/1992 Breugnot ..... G05F 3/245 323/314
2013/0241524 A1 9/2013 Inoue
2014/0043096 A1 2/2014 Finney
2015/0168969 A1* 6/2015 Shor ..... G05F 3/30 713/340

FOREIGN PATENT DOCUMENTS

CN 103681796 A 3/2014
JP 2013-191095 A 9/2013

* cited by examiner

*Primary Examiner* — Emily P Pham
(74) *Attorney, Agent, or Firm* — Pearne & Gordon LLP

(57) ABSTRACT

A band-gap referenced voltage circuit with smaller parasitic resistance which brings reduced band-gap error is disclosed. This reduced error stems from the unique configuration of stacked diode and a shorter wiring line to a resistor. The band-gap referenced voltage circuit includes two diodes, an operational amplifier with non-inverting and inverting inputs and an output for the band-gap voltage output, and three resistors. Employing the stacked configuration of the diode with the top anode electrode, the wiring line which connects the non-inverting input of the operational amplifier and the voltage reference diode is made short. Then the resistance of the wiring line, called also parasitic resistance, would be small.

3 Claims, 5 Drawing Sheets

BAND-GAP REFERENCE VOLTAGE CIRCUIT

BACKGROUND OF THE DISCLOSURE

1. Field of the Disclosure

The present disclosure relates to band-gap reference voltage circuits.

2. Description of the Related Art

As an example of a circuit that generates a reference voltage with low temperature dependence, a band-gap reference voltage circuit is known (for example, see Japanese Unexamined Patent Application Publication No. 2013-191095).

FIG. 4 is a diagram illustrating the typical configuration of a band-gap reference voltage circuit. A band-gap reference voltage circuit 400 includes an operational amplifier 110, resistors 120 to 122 and diodes 130 and 131.

One end of the resistor 120 is electrically connected to an output terminal of the operational amplifier 110 and the other end of the resistor 120 is electrically connected to a non-inverting input terminal of the operational amplifier 110. One end of the resistor 121 is electrically connected to the output terminal of the operational amplifier 110 and the other end of the resistor 121 is electrically connected to an inverting input terminal of the operational amplifier 110. An anode of the diode 130 is electrically connected to the non-inverting input terminal of the operational amplifier 110 and a cathode of the diode 130 is grounded. One end of the resistor 122 is electrically connected to the inverting input terminal of the operational amplifier 110 and the other end of the resistor 122 is electrically connected to an anode of the diode 131. A cathode of the diode 131 is grounded. The size of the diode 131 is around m times as large as the size of the diode 130.

In the band-gap reference voltage circuit 400, a band-gap reference voltage $V_{BG}$ is output from the output terminal of the operational amplifier 110.

The band-gap reference voltage $V_{BG}$ output from the band-gap reference voltage circuit 400 can be calculated in the following way.

The relation of the following expression (1) holds true between a voltage $V_A$ of the non-inverting input terminal and a voltage $V_B$ of the inverting input terminal due to the imaginary short circuiting of the non-inverting input terminal and the inverting input terminal of the operational amplifier 110.

$$V_A = V_B \tag{1}$$

A forward voltage $V_F$ of a diode is expressed by the following expression (2).

$$V_F = V_T \times ln(I/I_S + 1) \tag{2}$$

Here, $V_T$ is a thermal voltage KT/q (where k is the Boltzmann constant, T is the absolute temperature and q is an elementary electrical charge), I is a forward current and $I_S$ is a reverse saturation current.

The reverse saturation current $I_S$ is very small compared with the forward saturation current I and expression (2) is approximated by the following expression (3).

$$V_F = V_T \times ln(I/I_S) \tag{3}$$

When the resistances of the resistors 120 to 122 are respectively represented by $R_1$ to $R_3$, a parasitic resistance due to a wiring line between a point A (the connection point between resistor 120 and a diode 130) and the anode of the diode 130 is represented by $R_P$, and forward currents of the diodes 130 and 131 are respectively represented by $I_A$ and $I_B$, the following expression (4) is obtained from expression (1) and expression (3).

$$R_P \times I_A + V_T \times ln(I_A/I_S) = R_3 \times I_B + V_T \times ln(I_B/mI_S) \tag{4}$$

Here, if $R_1 = R_2$, $I_A = I_B$ and therefore the following expression (5) is obtained by replacing $I_A$ and $I_B$ in expression (4) with I.

$$I = 1/(R_3 + R_P) \times V_T \times ln(m) \tag{5}$$

Furthermore, the band-gap reference voltage $V_{BG}$ is expressed by the following expression (6).

$$V_{BG} = R_2 \times I + R_3 \times I + V_T \times ln(I/mI_S) \tag{6}$$

As a result of substituting I in expression (6) with expression (5), the band gap reference voltage $V_{BG}$ is expressed by the following expression (7).

$$V_{BG} = (R_2 + R_3)/(R_3 + R_P) \times V_T \times ln(m) + V_T \times ln(1/(mI_S \times (R_3 - R_P)) \times V_T \times ln(m)) \tag{7}$$

As illustrated in expression (7), the band-gap reference voltage $V_{BG}$ is affected by the parasitic resistance $R_P$. FIG. 5 is a diagram illustrating an example of the relationship between the parasitic resistance $R_P$ and the band-gap reference voltage $V_{BG}$. In the example illustrated in FIG. 5, a design value of the band-gap reference voltage $V_{BG}$ is around 1.23 V. If the parasitic resistance $R_P$ is about 40Ω, the band-gap reference voltage $V_{BG}$ is around 1.25 V. That is, the band-gap reference voltage $V_{BG}$ is shifted by around 20 mV from the design value.

The present disclosure was made in light of the above-described circumstances and an object thereof is to reduce an error in a band-gap reference voltage.

BRIEF SUMMARY OF THE DISCLOSURE

A band-gap reference voltage circuit according to an embodiment of the present disclosure includes an operational amplifier, a first diode having an anode electrically connected to a non-inverting input terminal of the operational amplifier and a grounded cathode, a first resistor having one end electrically connected to an output terminal of the operational amplifier and another end electrically connected to the anode of the first diode, a second resistor having one end electrically connected to the output terminal of the operational amplifier and another end electrically connected to an inverting input terminal of the operational amplifier, a third resistor having one end electrically connected to the inverting input terminal of the operational amplifier, and a second diode having an anode electrically connected to another end of the third resistor and a grounded cathode. One end of a first wiring line for electrically connecting the non-inverting input terminal of the operational amplifier and the anode of the first diode to each other, and one end of a second wiring line for electrically connecting the first resistor and the anode of the first diode to each other, are both connected to a connection terminal of the first diode stacked on the anode of the first diode. A band-gap reference voltage is output from the output terminal of the operational amplifier.

According to the present disclosure, an error in a band-gap reference voltage can be reduced.

Other features, elements, characteristics and advantages of the present disclosure will become more apparent from the following detailed description of embodiments of the present disclosure with reference to the attached drawings.

DETAILED DESCRIPTION OF THE DISCLOSURE

Figure 1:
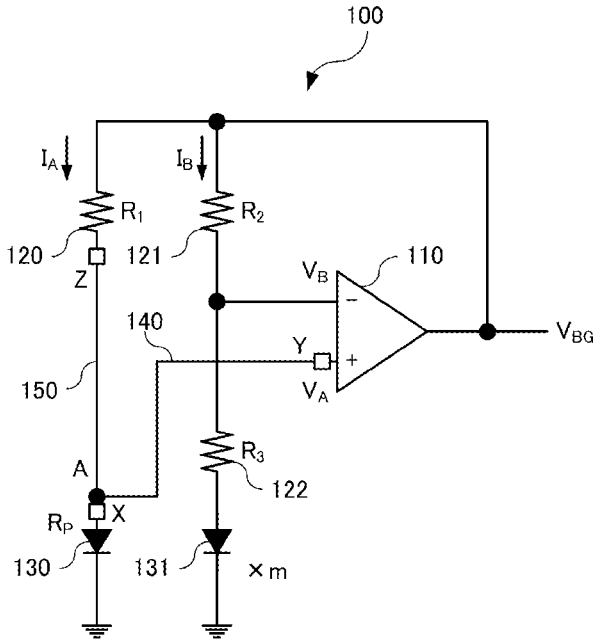
FIG. 1 is a diagram illustrating the configuration of a band-gap reference voltage circuit of an embodiment of the present disclosure.

Hereafter, an embodiment of the present disclosure will be described while referring to the drawings. FIG. 1 is a diagram illustrating the configuration of a band-gap reference voltage circuit of an embodiment of the present disclosure. A band-gap reference voltage circuit 100 includes an operational amplifier 110, a resistor 120 (first resistor), a resistor 121 (second resistor), a resistor 122 (third resistor), a diode 130 (first diode) and a diode 131 (second diode). Constituent elements and electrical connections of the band-gap reference voltage circuit 100 are the same as those of the band-gap reference voltage circuit 400 and therefore the description thereof is omitted.

As illustrated in FIG. 1, in the band-gap reference voltage circuit 100, a connection terminal X of the anode of the diode 130 and a connection terminal Y of a non-inverting input terminal of the operational amplifier 110 are connected to each other by a wiring line 140. In addition, the connection terminal X of the anode of the diode 130 and a connection terminal Z of the resistor 120 are connected to each other by a wiring line 150.

Figure 2:
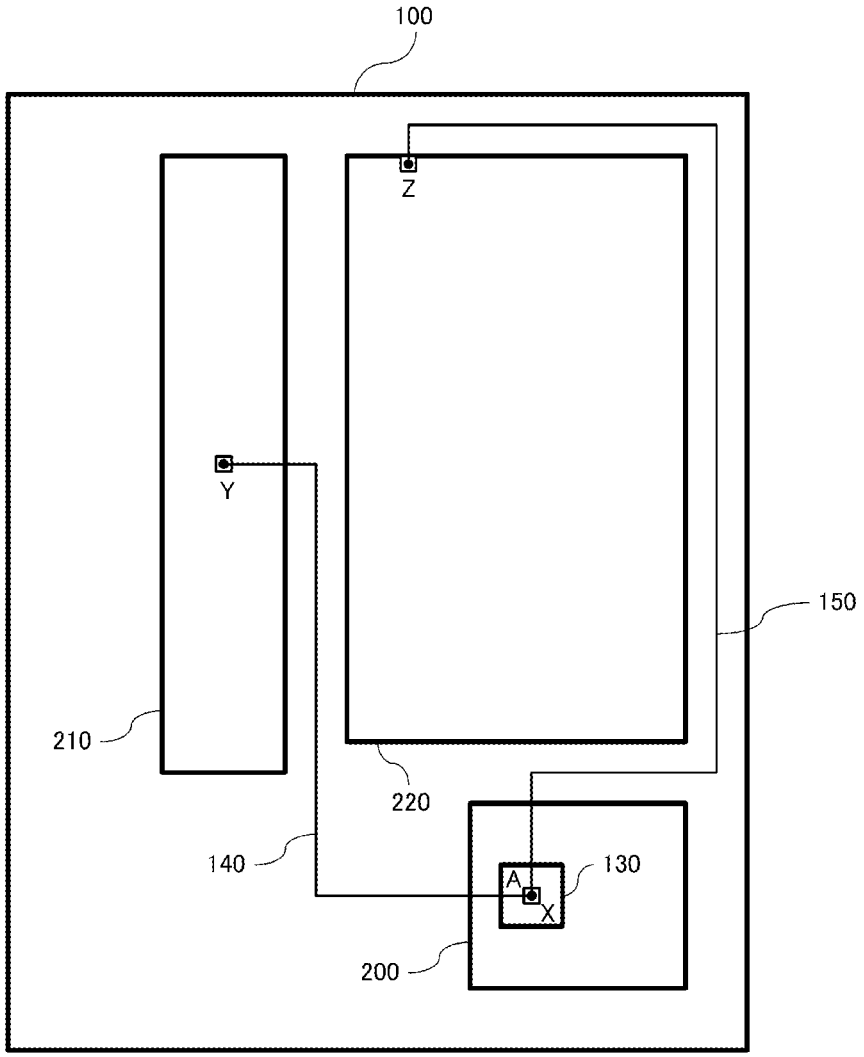
FIG. 2 is a diagram illustrating an example of an outline layout of the band-gap reference voltage circuit illustrated in FIG. 1.

FIG. 2 is a diagram illustrating an example of an outline layout of the band-gap reference voltage circuit 100 illustrated in FIG. 1. In FIG. 2, a region 200 in which the diodes 130 and 131 are arranged, a region 210 in which the operational amplifier 110 is arranged and a region 220 in which the resistors 120 to 122 are arranged are illustrated. In addition, in FIG. 2, the connection terminal X stacked on the anode of the diode 130, the connection terminal Y stacked on the non-inverting input terminal of the operational amplifier 110 and the connection terminal Z stacked on one end of the resistor 120 are illustrated. As described above, one end of the wiring line 140 is for electrically connecting the non-inverting input terminal of the operational amplifier 110 and the anode of the diode 130 to each other is connected to the connection terminal X of the anode of the diode 130. In addition, one end of the wiring line 150 for electrically connecting the resistor 120 and the anode of the diode 130 to each other is connected to the connection terminal X of the anode of the diode 130. The connection terminal X is arranged directly above the anode of the diode 130.

By providing the wiring lines 140 and 150 as illustrated in FIG. 1 and FIG. 2, the length of a wiring line between a point A (the connection point between resistor 120 and diode 130) and the anode of the diode 130 can be made comparatively short. Therefore, the parasitic resistance $R_P$ can be made comparatively small.

Figure 3:
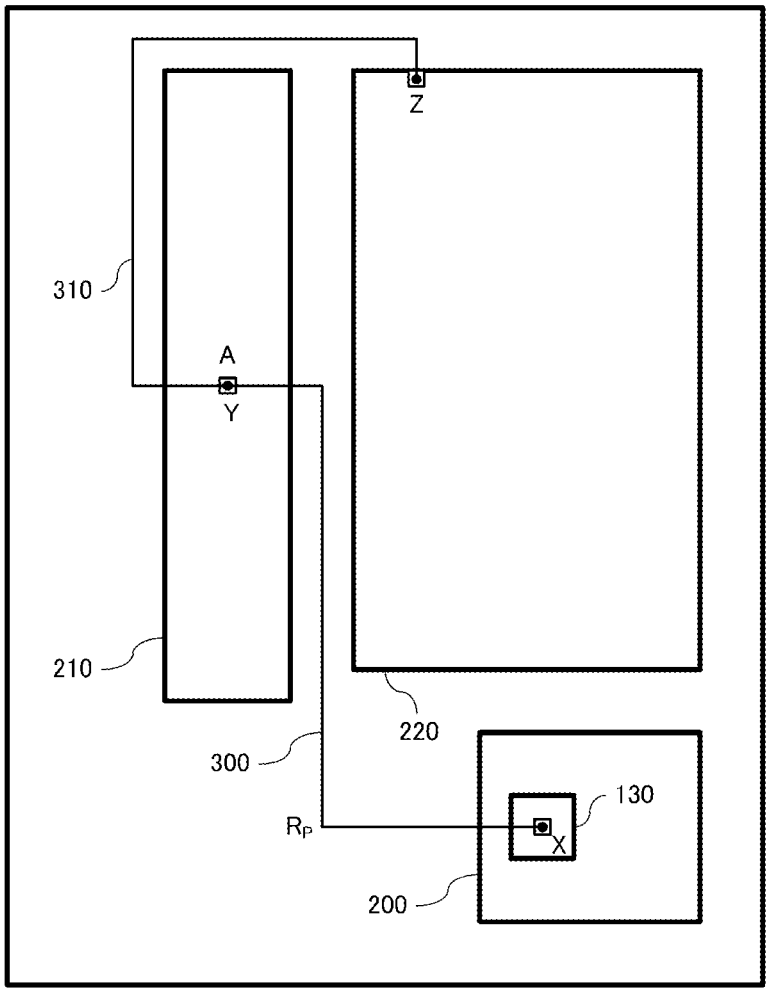
FIG. 3 is a diagram illustrating a comparative example of an outline layout.
Figure 4:
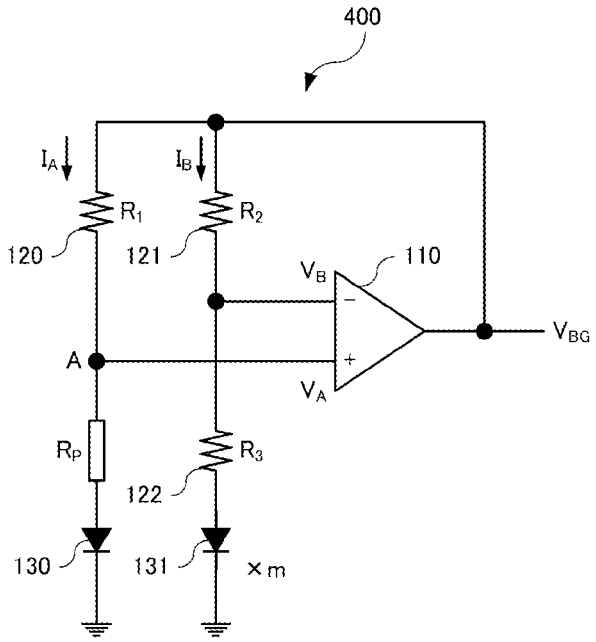
FIG. 4 is a diagram illustrating the typical configuration of a band-gap reference voltage circuit.
Figure 5:
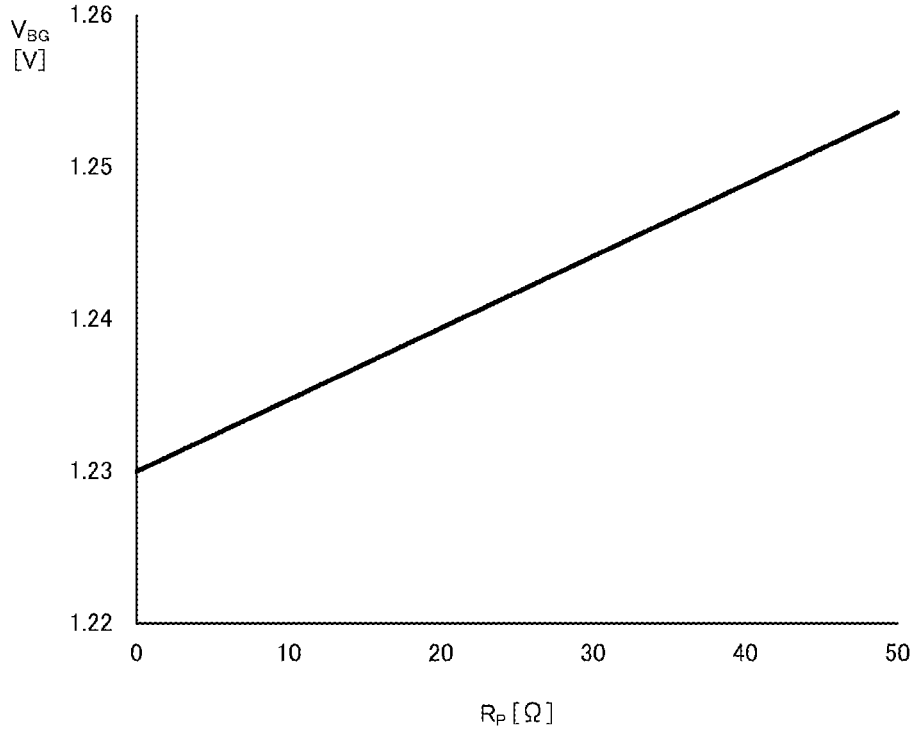
FIG. 5 is a diagram illustrating an example of the relationship between a parasitic resistance $R_P$ and a band-gap reference voltage $V_{BG}$.

FIG. 3 is a diagram illustrating a comparative example of an outline layout. In the example illustrated in FIG. 3, the connection terminal X of the anode of the diode 130 and the connection terminal Y of the non-inverting input terminal of the operational amplifier 110 are connected to each other by a wiring line 300. In addition, the connection terminal Y of the non-inverting input terminal of the operational amplifier 110 and the connection terminal Z of the resistor 120 are connected to each other by a wiring line 310. The length of a wiring line between the point A (the connection point between the resistor 120 and the diode 130) and the anode of the diode 130 is longer in this case than in the layout illustrated in FIG. 2. Therefore, the parasitic resistance $R_P$ is comparatively large.

An embodiment has been described above. According to this embodiment, one end of the wiring line 140 for electrically connecting the non-inverting input terminal of the operational amplifier 110 and the anode of the diode 130 to each other, and one end of the wiring line 150 for electrically connecting the resistor 120 and the anode of the diode 130 to each other are connected to the connection terminal X stacked on the anode of the diode 130, as illustrated in FIG. 1 and FIG. 2. With this configuration, the parasitic resistance $R_P$ due to the wiring line between the point A (the connection point between the resistor 120 and the diode 130) and the anode of the diode 130 can be made small compared with the case of the layout exemplified in FIG. 3. For example, the parasitic resistance $R_P$ is on the order of several tens of ohms in the case of the layout illustrated in FIG. 3, whereas it is possible to make the parasitic resistance $R_P$ be on the order of several hundred milliohms in the case of the layout illustrated in FIG. 2. Thus, an error in the band-gap reference voltage $V_{BG}$ can be reduced.

In the layout illustrated in FIG. 2, although the connection terminal X of the diode 130 is arranged directly above the anode of the diode 130, the position of the connection terminal X is not limited to this position. For example, the connection terminal X may be arranged not directly above but in the vicinity of the anode of the diode 130.

This embodiment is for allowing easy understanding of the present disclosure and is not to be interpreted as limiting the present disclosure. The present disclosure can be modified or improved without departing from the gist of the disclosure and equivalents to the present disclosure are to be also included in the scope of the present disclosure.

While embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A band-gap reference voltage circuit comprising:

an operational amplifier;

a first diode having an anode and a cathode, the anode being electrically connected to a non-inverting input terminal of the operational amplifier and the cathode being grounded;

a first resistor having one end electrically connected to an output terminal of the operational amplifier and another end electrically connected to the anode of the first diode;

a second resistor having one end electrically connected to the output terminal of the operational amplifier and another end electrically connected to an inverting input terminal of the operational amplifier;

a third resistor having one end electrically connected to the inverting input terminal of the operational amplifier; and a second diode having an anode and a cathode, the anode being electrically connected to another end of the third resistor and the cathode being grounded;

wherein one end of a first wiring line is configured to electrically connect the non-inverting input terminal of the operational amplifier to the anode of the first diode, and one end of a second wiring line is configured to electrically connect the first resistor to the anode of the first diode, said one end of the first wiring line and said one end of the second wiring line both being connected to a connection terminal of the first diode stacked on the anode of the first diode, and wherein a band-gap reference voltage is output from the output terminal of the operational amplifier.

2. The band-gap reference voltage circuit according to claim 1, wherein the connection terminal of the first diode is arranged in a vicinity of the anode of the first diode.

3. The band-gap reference voltage circuit according to claim 2, wherein the connection terminal of the first diode is arranged directly above the anode of the first diode.

* * * * *